US006875001B2

(12) United States Patent
Song et al.

(10) Patent No.: US 6,875,001 B2
(45) Date of Patent: Apr. 5, 2005

(54) RECIPROCATING COMPRESSOR

(75) Inventors: Gye-Young Song, Gwangmyong (KR); Ki-Chul Choi, Suwon (KR); Jin-Dong Kim, Gunpo (KR); Chang-Gyu Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/297,272

(22) PCT Filed: May 24, 2001

(86) PCT No.: PCT/KR01/00870

§ 371 (c)(1),
(2), (4) Date: Dec. 4, 2002

(87) PCT Pub. No.: WO02/081912

PCT Pub. Date: Oct. 17, 2002

(65) Prior Publication Data

US 2003/0091449 A1 May 15, 2003

(30) Foreign Application Priority Data

Apr. 4, 2001 (KR) ..... 2001-17966

(51) Int. Cl.[7] ..... F04B 17/04
(52) U.S. Cl. ..... 417/417; 417/416
(58) Field of Search ..... 417/415–418, 417/338, 363, 495, 545, 547, 552, 647; 92/110, 113

(56) References Cited

U.S. PATENT DOCUMENTS 6,089,836 A * 7/2000 Seo ..... 417/417
6,398,523 B1 * 6/2002 Hur et al. ..... 417/417
6,435,842 B2 * 8/2002 Song ..... 417/363
6,506,032 B2 * 1/2003 Kawahara et al. ..... 417/417
6,540,490 B1 * 4/2003 Lilie ..... 417/416

FOREIGN PATENT DOCUMENTS

| | | | |
|---|---|---|---|
| JP | 8-200213 A | 8/1996 | F04B/17/04 |
| JP | 8-219017 A | 8/1996 | F04B/17/04 |
| JP | 8-209922 A | 8/1997 | E04F/19/08 |
| KR | 1019990195439 A | 2/1999 | F04B/31/00 |

* cited by examiner

*Primary Examiner*—Charles G. Freay
(74) *Attorney, Agent, or Firm*—Birch, Stewart, Kolasch & Birch, LLP

(57) ABSTRACT

A reciprocating compressor, wherein a flange unit connected to the mover constituting the reciprocating motor is installed on the piston constituting the compressing unit, the distance between the piston flange unit and the front frame of the frame unit is shorter than that of the between the piston flange unit and the reciprocating motor. In the process of being transmitted the linear reciprocal movement driving force of the reciprocating motor and compressing the gas in the compressing unit, the stability of the compressor is raised by preventing the components moving together with the mover of reciprocating motor from impacting with other components by the displacement generated by compression force applying the piston constituting the compressing unit. Also, the size of compressor can be scaled down by compactly constituting the components.

8 Claims, 6 Drawing Sheets k < m m < p

RECIPROCATING COMPRESSOR

This application is the national phase under 35 U.S.C. § 371 of PCT International Application No. PCT/KR01/00870 which has an International filing date of May 24, 2001, which designated the United States of America.

TECHNICAL FIELD

The present invention relates to a reciprocating compressor, and in particular to a reciprocating compressor which is capable of constructing construction parts compactly, restraining collision noise occurrence by preventing collision of the construction parts in operation and stabilizing the operation.

BACKGROUND ART

Generally, a compressor is for compressing a fluid. The compressor can be divided into a rotation compressor, a reciprocating compressor and a scroll compressor, etc. according to fluid compression types.

In the rotation compressor, a rotational shaft rotates by receiving a driving force of a rotational motor, simultaneously an eccentric part combined with the rotational shaft performs an eccentric rotation in a cylindrical compression space of a cylinder, and accordingly gas is compressed.

In the scroll compressor, a rotational shaft rotates by receiving a driving force of a rotational motor, simultaneously a rotary scroll combined with the rotational shaft engaging with a fixed scroll performs a rotating motion, and accordingly gas is compressed.

In the reciprocating compressor, a rotational shaft rotates by receiving a driving force of a rotational motor, simultaneously a connecting rod combined with the rotational shaft converts the rotating motion into a linear reciprocating motion and transmits it to a piston, the piston performs the linear reciprocating motion in a cylinder, and accordingly gas is compressed.

In addition, in another type of the reciprocating compressor, a piston receiving a driving force of a reciprocating motor performs a linear reciprocating motion in a cylinder, and accordingly gas is compressed.

FIG. 1 illustrates a reciprocating compressor in accordance with the conventional art. As depicted in FIG. 1, the reciprocating compressor includes a container 100 having a suction pipe 10 in which gas is sucked; a frame unit installed inside the container 100; a reciprocating motor installed at the frame unit and generating a linear reciprocating driving force; a compression unit installed at the frame unit with a certain distance from the reciprocating motor, receiving the driving force of the reciprocating motor and compressing gas; a spring unit for elastically supporting the linear reciprocating driving force of the reciprocating motor; and a valve unit installed at the compression unit and opening/closing a compression space in which gas is compressed.

The container 100 is sealed to have a certain inner space, and the suction pipe 10 penetrates-combines with the container 100 so as to communicate with the container 100.

The reciprocating motor consists of an outer stator 310 installed at a rear frame 210 of the frame unit; an inner stator 320 inserted into the outer stator 310 with a certain interval; a wound coil 330 inserted into an open groove 311 formed at the outer stator 310; and a mover 340 inserted between the outer stator 310 and the inner stator 320 to perform a linear reciprocating motion.

And, a middle frame 220 is fixedly combined with a certain side of the reciprocating motor to face the rear frame 210.

The compression unit includes a cylinder 410 combined with a front frame 230 having a certain distance from the reciprocating motor and a piston 420 inserted into a compression space 411 of the cylinder 410 and connected to the mover 340 of the reciprocating motor.

And, in the front frame 230, a protrusive supporting portion 232 extended from a certain side of a plate portion 231 is formed so as to have a certain length, and a through hole 233 in which the cylinder 410 is inserted is formed at the supporting portion 232.

In the cylinder 410, the compression space 411 penetrates through a cylinder body 412 having a certain length. And, the cylinder 410 is inserted into the through hole 233 of the front frame 230.

Herein, the end surface of the supporting portion 232 of the front frame 230 is the same surface as the end surface of the cylinder body 412.

The piston 420 includes a body unit 421 having a certain length and a flange portion 422 extended from a certain side of the body unit 421 so as to have a certain size and connected to the mover 340.

In the piston 420, the flange portion 422 is combined with the mover 340, and the body unit 421 is inserted into he compression space 411 of the cylinder 410.

The spring unit includes a certain-shaped spring supporting portion 510 in which a certain side is combined with the flange portion 422 of the piston 420 or the mover 340 so as to place between the front frame 230 and the middle frame 220; and a spring 520 respectively placed at both sides of the spring supporting portion 510.

The valve unit includes a discharge cover 610 combined with the front frame 230 to cover the compression space 411 of the cylinder; a discharge valve 620 placed inside the discharge cover 610 and opening/closing the compression space 411 of the cylinder 410; a valve spring 630 for elastically supporting the discharge valve 620; and a suction valve 640 combined with the end of the piston 420 and opening/closing a suction channel 423 formed inside the piston 420.

Unexplained reference numeral 20 is a discharge pipe, 240 is a connecting member of the frame unit, and 341 is a permanent magnet.

The operation of the conventional reciprocating compressor will be described.

When power is applied to the reciprocating motor, a current flows onto the wound coil 330 of the reciprocating motor, a flux is formed between the outer stator 310 and the inner stator 320, by mutual operation of the flux between the outer stator 310 and the inner stator 320 with a flux by the permanent magnet 341 of the mover 340, the mover 340 performs a linear reciprocating motion.

The linear reciprocating driving force of the mover 340 is transmitted to the piston 420, and the piston 420 performs a linear reciprocating motion inside the cylinder compression space 411.

The spring unit stores, discharges the linear reciprocating power of the reciprocating motor as elastic energy and causes a resonance motion.

With the linear reciprocating motion of the piston 420 in the compression space 411 of the cylinder 410, the valve unit is operated, the gas sucked into the suction pipe 10 is sucked into the compression space 411 through the suction channel 423 of the piston 420, compressed discharged, herein, the gas is discharged to the outside through the discharge pipe 20 of the discharge cover 610.

In general, the compressor includes a cooling cycle apparatus and is installed to an air-conditioner, a refrigerator and a showcase, etc. In order to install the compressor to a system such as an air-conditioner, a refrigerator and a showcase, etc., the compressor has to have a simple structure and require a small installation space and operate stably.

In the meantime, unlike other compressors, in the reciprocating compressor, an output of the reciprocating motor as a driving power source is a linear reciprocating motion power, the piston 420 receives the linear reciprocating motion power of the reciprocating motor and performs the linear reciprocating motion in the compression space 411 to compress the gas, and accordingly constructing parts moving in the axial direction compactly is important object to simplify a structure of the compressor.

In the meantime, as depicted in FIG. 2, in a reciprocating compressor constructed by considering the above-mentioned object, in the linear reciprocating motion of the flange portion 422 of the piston (receiving the driving force of the reciprocating motor and performing the linear reciprocating motion in the compression space 411 of the cylinder), a distance between the inner stator 320 of the reciprocating motor respectively placed at both sides of the flange portion 422 and the front frame 230 corresponds to a reciprocating motion distance of the flange portion 422.

And, the flange portion 422 of the piston 420 is placed between the inner stator 320 and the front frame 230, a distance (a) between the end surface of the front frame 230 and the flange portion 422 is the same as a distance (b) between the inner stator 320 and the flange portion 422.

And, as depicted in FIG. 3, in the cylinder 410 in which the piston 420 is inserted and the front frame 230 of the frame unit in which the cylinder 410 is inserted, the end surface (c) of the cylinder 410 is placed on the same surface as the end surface (d) of the supporting portion 232.

In the above-mentioned construction, the piston 420 receives the linear reciprocating driving force of the reciprocating motor, sucks, compresses and discharges the gas while performing the linear reciprocating motion in the compression space 411 of the cylinder 410, however, by the compressed gas force in the compression space 411, the center of the reciprocating motion of the piston 420 may be moved from an initial position toward the reciprocating motor, due to that, the flange portion 422 of the piston 420 may collide against the inner stator 320 of the reciprocating motor during the linear reciprocating motion, and accordingly collision noise may occur and the operation may be unstable.

In addition, when the piston 420 performs the unstable reciprocating motion, the flange portion 422 of the piston 420 may collide against the end surface (d) of the supporting portion 232 of the front frame 230 and the end surface (C) of the piston 420, impact may be applied to the piston 420 and the front frame 230, and accordingly the assembly condition of the valve unit connected to the cylinder 410 may not be secured.

TECHNICAL GIST OF THE PRESENT INVENTION

In order to solve the above-described problems, it is an object of the present invention to provide a reciprocating compressor which is capable of constructing construction parts compactly, restraining collision noise occurrence by preventing collision between the construction parts in operation and stabilizing the operation.

In order to achieve the above-mentioned object, in a reciprocating compressor comprising a container having a suction pipe in which gas is sucked; a frame unit installed inside the container; a reciprocating motor installed at the frame unit and generating a linear reciprocating driving force; a compression unit installed at the frame unit so as to have a certain distance from the reciprocating motor, receiving the driving force of the reciprocating motor and compressing gas; a spring unit for elastically supporting the linear reciprocating driving force of the reciprocating motor; and a valve unit installed at the compression unit and opening/closing the compression space in which gas is compressed, wherein the piston of the compression unit has a flange portion connected to a mover of the reciprocating motor, a distance (k) between a front frame of the frame unit and the flange portion of the piston is smaller than a distance (m) between the reciprocating motor and the flange portion of the piston.

BRIEF DESCRIPTION OF DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, the preferred embodiment of the present invention will be described with reference to accompanying drawings.

Figure 1:
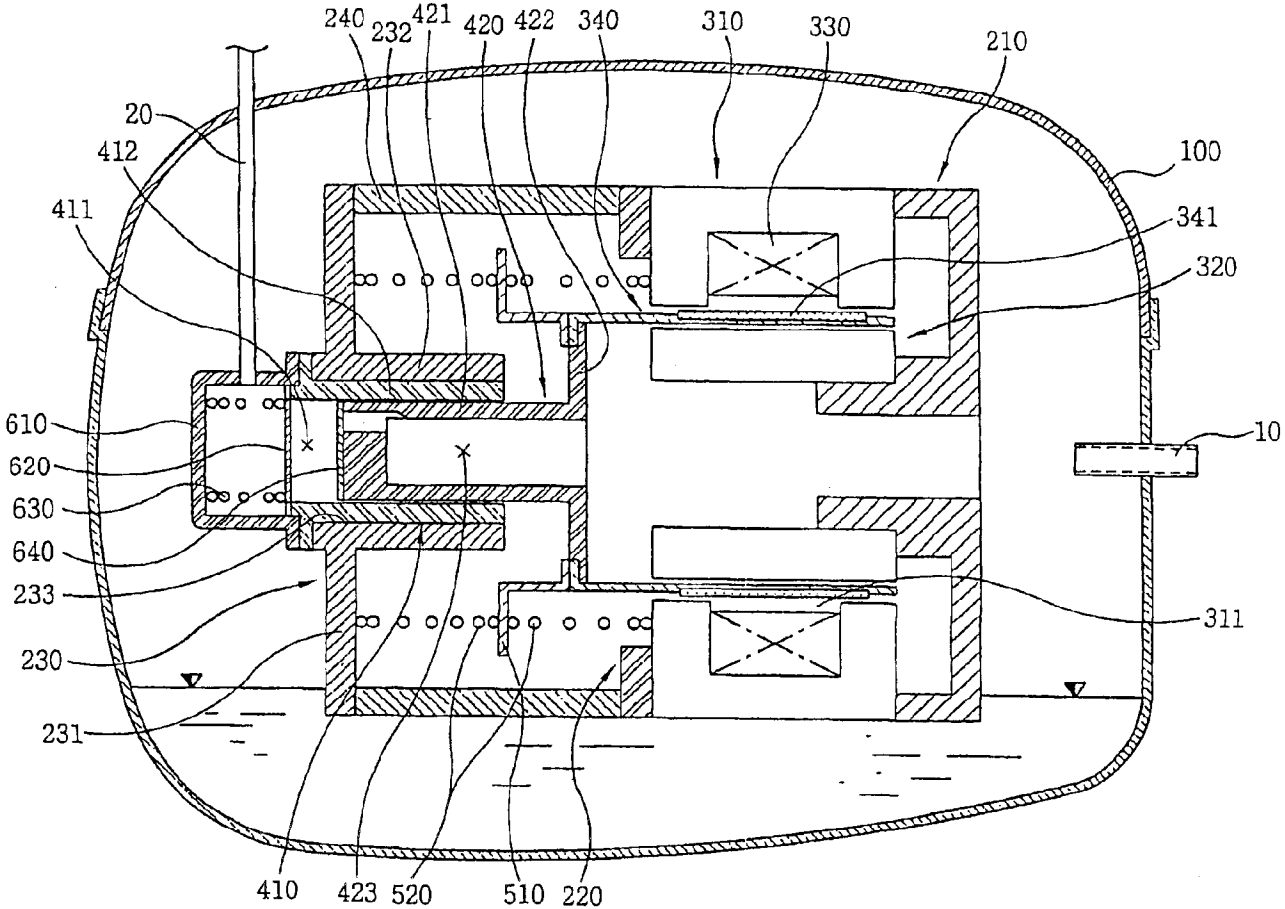
FIG. 1 BACKGROUND ART
FIG. 1 illustrates a reciprocating compressor in accordance with the conventional art.
Figure 2:
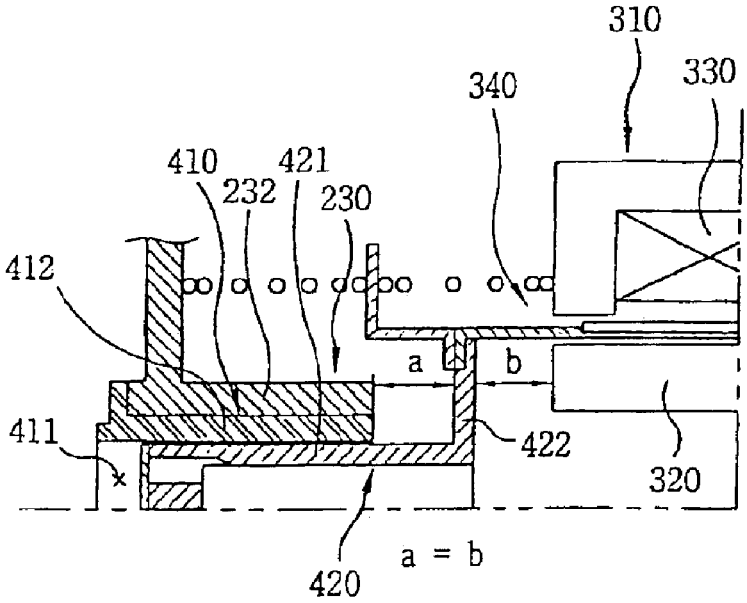
FIG. 2 BACKGROUND ART
FIG. 2 is a sectional view illustrating major parts of the reciprocating compressor.
Figure 3:
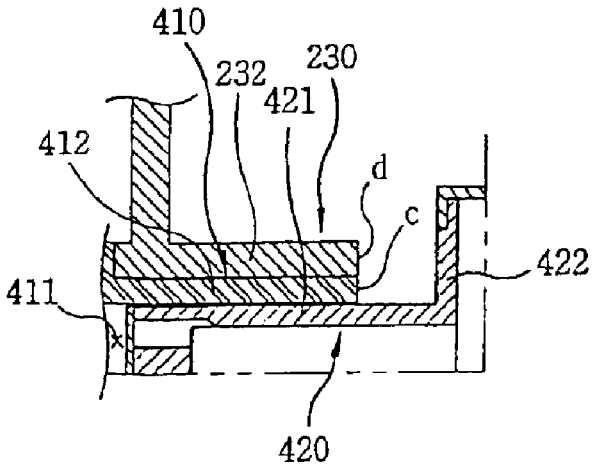
FIG. 3 BACKGROUND ART
FIG. 3 is a sectional view illustrating major parts of the reciprocating compressor.
Figure 4:
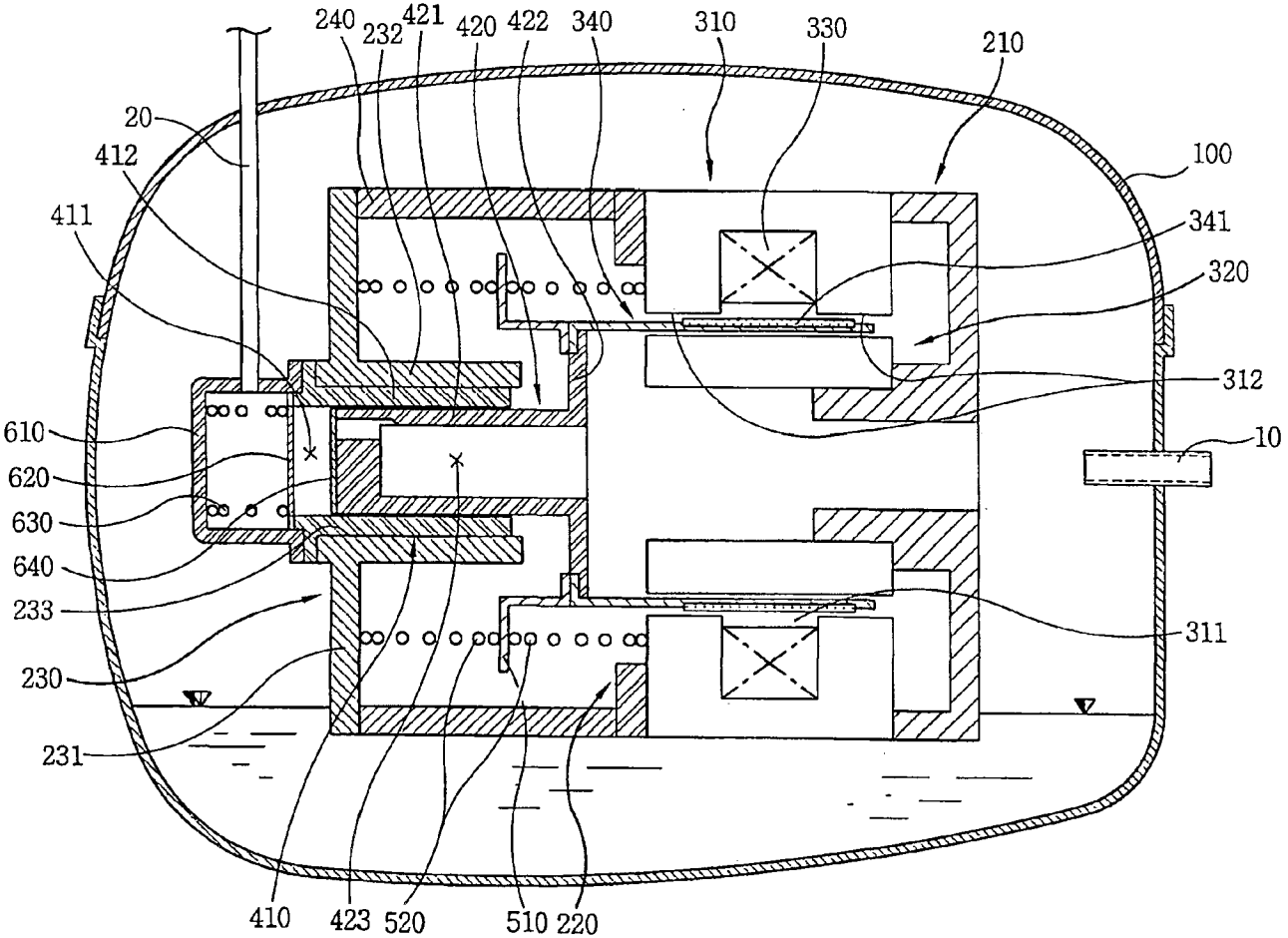
FIG. 4 is a sectional illustrating a reciprocating compressor in accordance with the present invention.

As depicted in FIG. 4, a reciprocating compressor in accordance with the present invention includes a container having a suction pipe in which gas is sucked; a frame unit installed inside the container; a reciprocating motor installed at the frame unit and generating a linear reciprocating driving force; a compression unit installed at the frame unit so as to have a certain distance from the reciprocating motor, receiving the driving force of the reciprocating motor and compressing gas; a spring unit for elastically supporting the linear reciprocating driving force of the reciprocating motor; and a valve unit installed at the compression unit and opening/closing the compression space in which gas is compressed.

The container 100 is sealed to have a certain inner space, and the suction pipe 10 penetrates-combines with the container 100 so as to communicate with the container 100.

The compression unit includes a cylinder 410 combined with a front frame 230 having a certain distance from the reciprocating motor and a piston 420 inserted into a compression space 411 of the cylinder 410 and connected to the mover 340 of the reciprocating motor.

And, in the front frame 230, a protrusive supporting portion 232 extended from a certain side of a plate portion 231 is formed so as to have a certain length, and a through hole 233 in which the cylinder 410 is inserted is formed at the supporting portion 232.

And, the supporting portion 232 of the front frame 230 is projected toward the reciprocating motor.

In the cylinder 410, the compression space 411 penetrates through a cylinder body 412 having a certain length. And, the cylinder 410 is inserted into the through hole 233 of the front frame 230.

Figure 5:
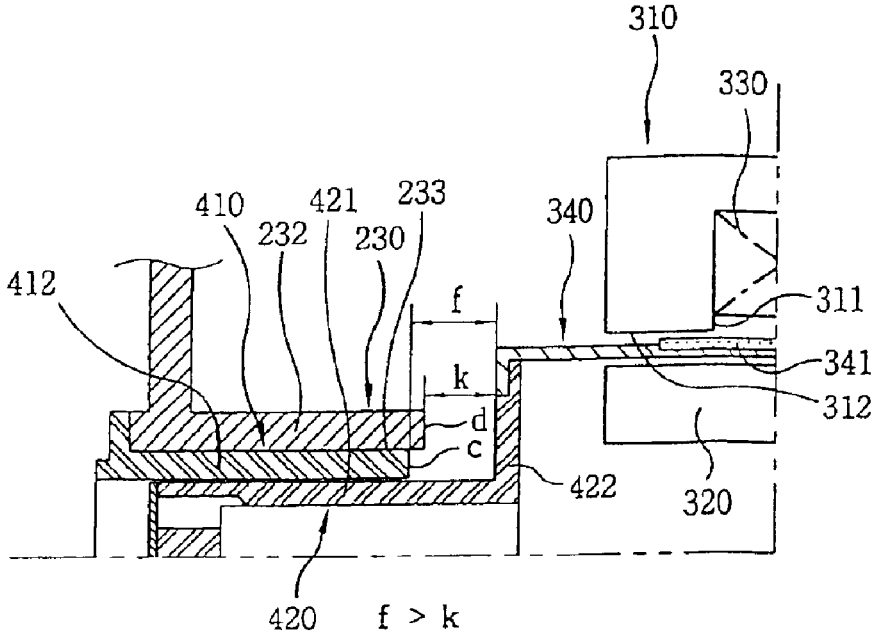
FIG. 5 is a sectional view illustrating major parts of the reciprocating compressor in accordance with the present invention.

As depicted in FIG. 5, when the cylinder 410 is inserted into the through hole 233 of the front frame 230, the end of the cylinder 410 is placed inside the through hole 233 of the supporting portion 232 of the front frame 230.

In more detail, the end surface (d) of the supporting portion 232 of the front frame 230 is combined with the end surface (c) of the cylinder 410 as a step structure to make a distance (k) between the flange portion 422 of the piston 420 and the end surface (d) of the supporting portion 232 shorter than a distance (f) between the flange portion 422 of the piston 420 and the end surface (c) of the cylinder 410.

The piston 420 includes a body unit 421 having a certain length; and a flange portion 422 extended from a certain side of the body unit 421 so as to have a certain size and connected to the mover 340.

The reciprocating motor consists of an outer stator 310 installed at a rear frame 210 of the frame unit; an inner stator 320 inserted into the outer stator 310 with a certain interval; a wound coil 330 inserted into an open groove 311 formed at the outer stator 310; and a mover 340 inserted between the outer stator 310 and the inner stator 320 so as to perform a linear reciprocating motion.

When a current flows onto the wound coil 330, the outer stator 310 and the inner stator 320 form a closed loop in which a flux flows, herein, both sides of the open groove 311 of the outer stator 310 are pole portions 312 respectively forming each pole.

Figure 6:
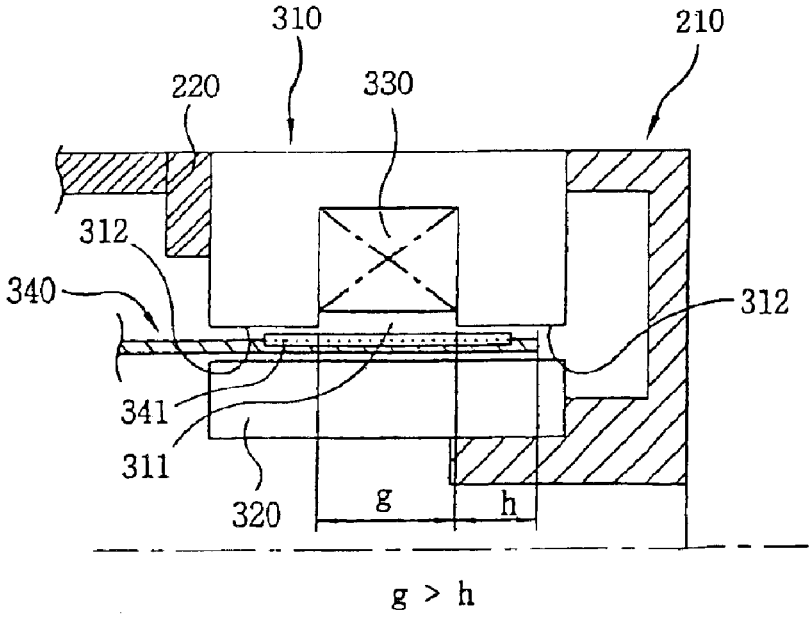
FIG. 6 is a sectional view illustrating major parts of the reciprocating compressor in accordance with the present invention.

As depicted in FIG. 6, the mover 340 includes a permanent magnet 341 having a certain length. The permanent magnet 341 has the same length as an added length of an inlet length (g) of the open groove 311 and the one pole portion length (h), places along the both pole portions 312 of the outer stator 310 and faces the open groove 311. In addition, the center of the permanent magnet 341 and the open groove 311 are eccentric.

In more detail, on the basis of the center of the open groove 311, the center of the permanent magnet 341 is placed so as to be eccentric as a certain amount toward the compression unit.

And, a middle frame 220 is fixedly combined with the reciprocating motor to combine the outer stator 310 of the reciprocating motor with the rear frame 210.

In more detail, the middle frame 220 is placed between the front frame 230 and the rear frame 210.

And, the frame unit includes the front, middle and rear frames 230, 220, 210 and a connecting member 240 placed between the front and middle frames 230, 220.

The mover 340 of the reciprocating motor is connected to the flange portion 422 of the piston 420 constructing the compression unit.

Figure 7:
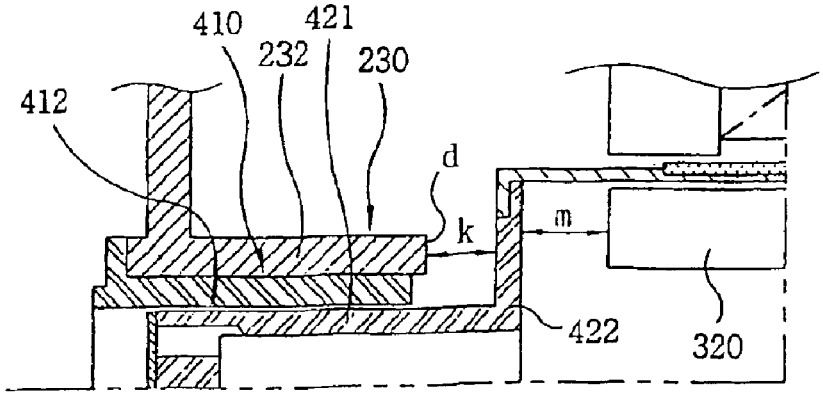
FIG. 7 is a sectional view illustrating major parts of the reciprocating compressor in accordance with the present invention.

As depicted in FIG. 7, the flange portion 422 of the piston 420 is placed between the front frame 230 and the reciprocating motor, a distance (k) between the flange portion 422 and the front frame 230 is smaller than a distance (m) between the flange portion 422 and the reciprocating motor.

In more detail, the distance (k) between the end surface (d) of the supporting portion 232 and one side of the reciprocating motor facing the flange portion 422 is smaller than the distance (m) between the inner stator 320 of the reciprocating motor and the flange portion 422.

Figure 8:
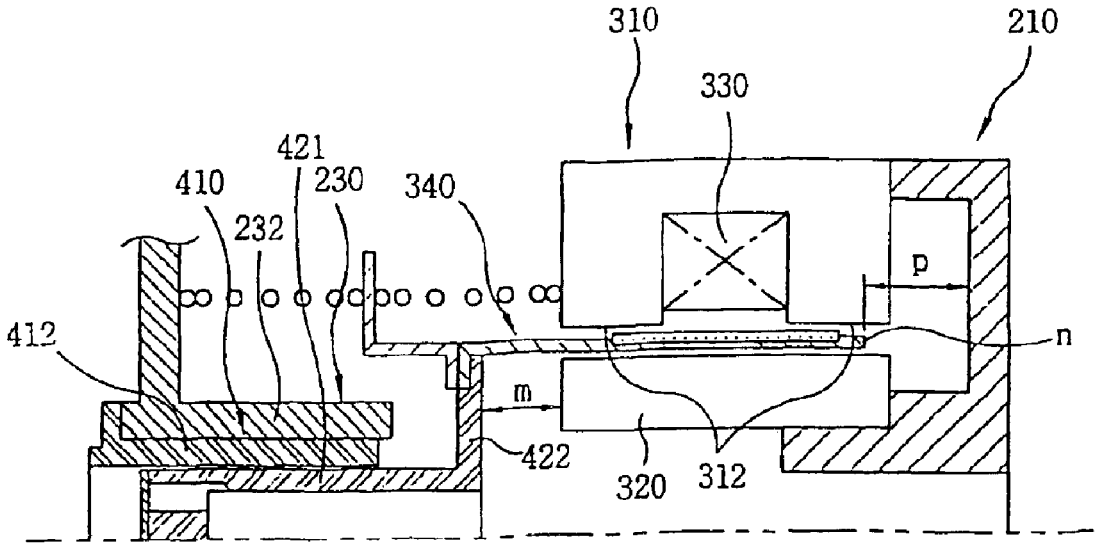
FIG. 8 is a sectional view illustrating major parts of the reciprocating compressor in accordance with the present invention.

As depicted in FIG. 8, the distance (m) between the flange portion 422 and the one side of the reciprocating motor facing the flange portion 422 is smaller than a distance (p) between the end surface (n) of the mover 34*b* and the rear frame 210 facing the end surface (n).

Figure 9:
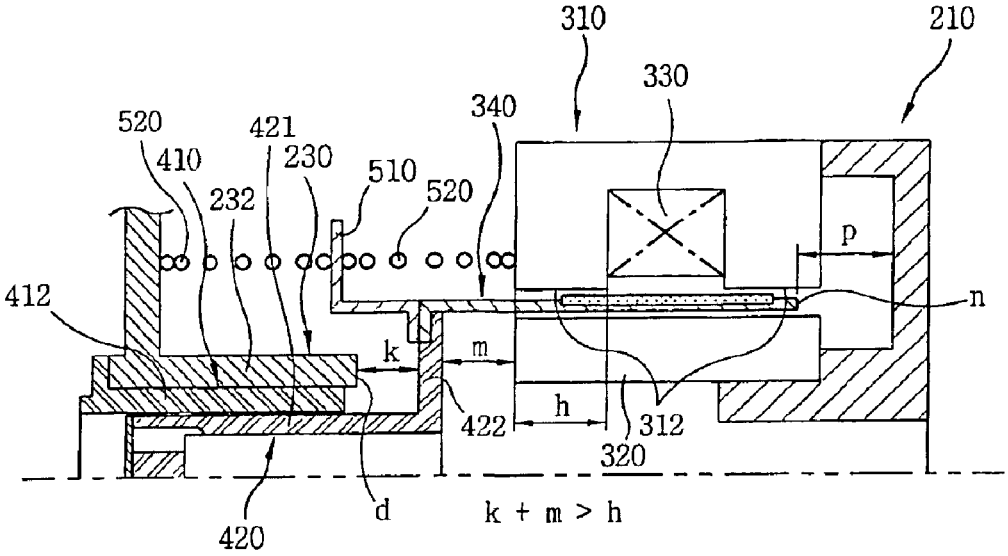
FIG. 9 is a sectional view illustrating major parts of the reciprocating compressor in accordance with the present invention.

As depicted in FIG. 9, the height of the pole portion 312 is smaller than an added distance ((k)+(m)) of the distance (k) between the end surface (d) of the supporting portion 232 and the flange portion 422 and the distance (m) between the flange portion 422 and the reciprocating motor facing the flange portion 422.

The spring unit includes a certain-shaped spring supporting portion 510 in which a certain side is combined with the flange portion 422 of the piston 420 or the mover 340 so as to lie between the front frame 230 and the middle frame 220; and a spring 520 respectively placed at both sides of the spring supporting portion 510.

The valve unit includes a discharge cover 610 combined with the front frame 230 to cover the compression space 411 of the cylinder; a discharge valve 620 placed inside the discharge cover 610 and opening/closing the compression space 411 of the cylinder 410; a valve spring 630 for elastically supporting the discharge valve 620; and a suction valve 640 combined with the end of the piston 420 and opening/closing a suction channel 423 formed inside the piston 420.

Figure 10:
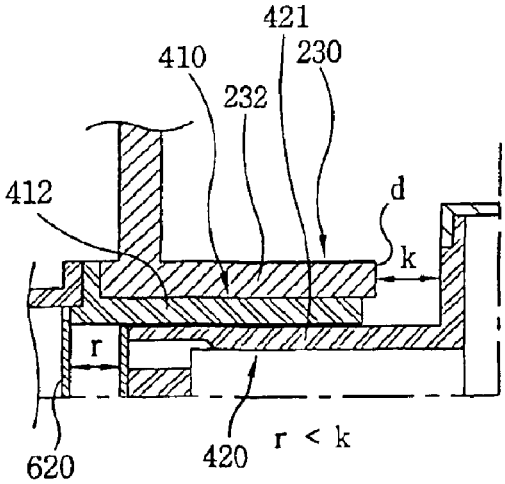
FIG. 10 is a sectional view illustrating major parts of the reciprocating compressor in accordance with the present invention.

And, as depicted in FIG. 10, a distance (r) between the discharge valve 620 and the end of the piston 420 (the suction valve 640 combined with the end of the piston 420) is smaller than a distance (k) between the end surface (d) of the supporting portion 232 and the flange portion 422 of the piston 420.

Hereinafter, advantages of the reciprocating compressor in accordance with the present invention will be described.

When power is applied to the reciprocating motor, a current flows onto the wound coil 330 of the reciprocating motor, a flux is formed between the outer stator 310 and the inner stator 320, by mutual operation of the flux between the outer stator 310 and the inner stator 320 with a flux by the permanent magnet 341 of the mover 340, the mover 340 performs a linear reciprocating motion.

Herein, a reciprocating motion distance of the mover 340 is determined by the permanent magnet 341 and the outer stator 310 of the mover 340. In more detail, a length of the permanent magnet 341 is the same as the added length ((h)+(g)) of a length (h) of the pole 312 and an inlet length (g) of the open groove 311, the permanent magnet 341 is moved by the mutual operation of the flux formed on the inner and outer stators 310, 320 according to the current flowing onto the wound coil 330, the reciprocating distance of the permanent magnet 341 is the length (h) of the pole portion 312 of the outer stator 310, and accordingly the end of the permanent magnet 341 does not escape from the end of the pole portion 312 in the linear reciprocating motion.

And, the linear reciprocating driving force of the mover 340 is transmitted to the piston 420 combined with the mover 340, the piston 420 performs a linear reciprocating motion in the compression space 411.

Herein, the flange portion 422 of the piston 420 connected to the mover 340 performs a reciprocating motion between the end surface (d) of the supporting portion 232 (of the front frame 230) and the inner stator 320 of the reciprocating motor.

The spring unit stores, discharges the linear reciprocating force of the reciprocating motor as elastic energy and causes a resonance motion.

With the linear reciprocating motion of the piston 420 in the compression space 411 of the cylinder 410, the valve unit is operated, the gas sucked into the suction pipe 10 is sucked into the compression space 411 through the suction channel 423 of the piston 420, compressed discharged, herein, the gas is discharged to the outside through the discharge pipe 20 of the discharge cover 610.

In more detail, when the piston 420 is moved to the bottom dead center, the suction valve 620 is curved due to a pressure difference between the compression space 411 and the outside, the suction valve 423 is open, and accordingly the gas of the suction pipe 10 is sucked into the compression space 411 through the suction channel 423.

And, when the piston 420 is moved from the bottom dead center to the upper dead center, the suction valve 620 closes the suction channel 423, the gas of the compression space 411 of the cylinder 410 is compressed and reaches a set pressure state, the discharge valve 620 of the valve unit is open, and accordingly the compressed gas is discharged.

As described above, the piston 420 compresses the gas by performing the reciprocating motion in the compression space 411 of the cylinder 410.

While the piston 420 compresses the gas by moving between the bottom dead center and the upper dead center by the driving force of the reciprocating motor, the pressure force of the gas acts on the piston 420.

In the present invention, because the flange portion 422 of the piston 420, which places between the supporting portion 232 of the front frame 230 and the inner stator 320 of the reciprocating motor and performs a linear reciprocating motion by receiving the driving force form the reciprocating motor, is placed toward the supporting portion 232 of the front frame 230, although the piston 420 is pushed by the gas pressure force, the piston 420 can move in a position-compensated state.

The piston 420 performs the linear reciprocating motion in the state pushed toward the reciprocating motor side by the pressure force, the flange portion 422 of the piston 420 in the eccentric state toward the front frame side is operated between the front frame 230 and the inner stator 320 of the reciprocating motor, and accordingly it is possible to prevent the flange portion 422 of the piston 420 from colliding against other construction parts.

In more detail, collision of the flange portion 422 against other parts is prevented, and a distance between the supporting portion 232 of the front frame 230 and the inner stator 320 of the reciprocating motor is minimized.

In addition, in the present invention, by making the distance (k) between the end surface (d) of the supporting portion 232 and the flange portion 422 smaller than the distance (m) between the end surface (c) of the cylinder 410 and the flange portion 422 of the piston 420, when the flange portion 422 of the piston 420 excessively moves toward the front frame side in the unstable operation, the flange portion 422 does not collide against the cylinder 410 but collide against the supporting portion 232 of the front frame 230, and accordingly impact of the collision can be minimized.

In addition, by making the distance (k) between the end surface (d) of the supporting portion 232 and the flange portion 422 of the piston 420 greater than a distance (r) between the discharge valve 620 and the end of the piston 420 (the suction valve 640 combined with the end of the piston 420), the piston 420 can move to the upper dead center without colliding the flange portion 422 against the supporting portion 232 of the front frame 230.

In addition, by making the length (h) of the pole portion of the outer stator as the basis of the reciprocating motion distance of the mover 340 of the reciprocating motor smaller than an added distance ((k)+(m)) of the distance (k) between the end surface (d) of the supporting portion 232 and the flange portion 422 and the distance (m) between one side of the inner stator 320 of the reciprocating motor and the flange portion 422, it is possible to prevent the flange portion 422 of the piston 420 performing the linear reciprocating motion with the mover 340 from colliding against the supporting portion 232 of the front frame 230 and the inner stator 320 of the reciprocating motor.

In addition, by making the distance (m) between the flange portion 422 of the piston 420 and the reciprocating motor facing the flange portion 422 smaller than a distance (p) between the end surface (n) of the mover 340 and the rear frame 210 facing the end surface (n), in the unstable operation of the mover 340 or the piston 420, before the mover 340 collides against the rear frame 210, the flange portion 422 of the piston 420 collides against a certain side of the inner stator 320 of the reciprocating motor, and accordingly it is possible to minimize damage of construction parts.

In addition, on the basis of the center of the open groove 311 at which the wound coil 330 is placed, the center of the permanent magnet 341 is placed toward the compression unit, when the piston 420 and the mover 340 are pushed by the pressure power in the operation, the mover 340 moves in the position-compensated state, and accordingly the permanent magnet 341 of the mover 340 does not escape from the end of the pole portion 312 of the outer stator 310 and move stably.

INDUSTRIAL APPLICABILITY

As described above, in the reciprocating compressor in accordance with the present invention, by preventing collision of parts moving with the mover of the reciprocating motor against other parts due to displacement occurred by the pressure power acting on the piston of the compression unit while pressing gas in the compression unit by receiving the linear reciprocating driving force of the reciprocating motor, damage of construction parts can be prevented, and accordingly it is possible to improve stability of the compressor. In addition, by constructing the parts compactly, it is possible to miniaturize the compressor.

What is claimed is:

1. A reciprocating compressor comprising:

a container having a suction pipe in which gas is sucked;

a frame unit having a front frame installed inside the container;

a reciprocating motor installed at the frame unit and generating a linear reciprocating driving force;

a compression unit installed at the frame unit with a certain distance from the reciprocating motor, receiving the driving force of the reciprocating motor and compressing gas;

a spring unit for elastically supporting the linear reciprocating driving force of the reciprocating motor; and a valve unit installed at the compression unit and opening/closing a compression space in which gas is compressed, wherein a piston of the compression unit has a flange portion located between the motor and front frame and connected to a mover of the reciprocating motor, and wherein a distance (k) between a front frame of the frame unit and the flange portion of the piston is smaller than a distance (m) between the reciprocating motor and the flange portion of the piston.

2. The compressor of claim 1, wherein the compression unit has a cylinder and a distance (r) between a discharge valve of the valve unit for opening/closing the compression space of the cylinder and a suction valve combined with the end of the piston for opening and closing a flow channel of the piston is shorter than a distance (k) between the end surface of the supporting portion of the front frame in which the cylinder is inserted and the flange portion of the piston.

3. The compressor of claim 1, wherein a length (h) of a pole portion of a stator of the reciprocating motor is smaller than an added distance ((k)+(m)) of a distance (k) between the flange portion of the piston and the end surface of the supporting portion of the front frame and a distance (m) between the flange portion of the piston and one side of the reciprocating motor.

4. The compressor of claim 1, wherein the certain distance is defined in a moving direction of the reciprocating motor.

5. The compressor of claim 1, wherein the distance (k) between the front frame of the frame unit and the flange portion of the piston is smaller than the distance (m) between the reciprocating motor's stator and the flange portion of the piston.

6. A reciprocating compressor comprising:

a container having a suction pipe in which gas is sucked, a frame unit frame installed inside the container;

a reciprocating motor installed at the frame unit and generating a linear reciprocating driving force;

a compression unit installed at the frame unit with a certain distance from the reciprocating motor, receiving the driving force of the reciprocating motor and compressing gas;

a spring unit for elastically supporting the linear reciprocating driving force of the reciprocating motor; and a valve unit installed at the compression unit opening/closing a compression space in which gas is compressed, wherein a piston of the compression unit has a flange portion connected to a mover of the reciprocating motor, a distance (k) between a front frame of the frame unit and the flange portion of the piston is smaller then the distance (m) between the reciprocating motor and the flange portion of the piston, and wherein the compression unit has a cylinder and the front frame includes a supporting portion in which the cylinder of the compression unit is inserted, and a distance (f) between the flange portion of the piston and the end surface of the cylinder inserted into the supporting portion of the front frame is greater than and a distance (k) between the flange portion of the piston and the end surface of the supporting portion of the front frame.

7. A reciprocating compressor comprising:

a container having a suction pipe in which gas is sucked, a frame unit frame installed inside the container;

a reciprocating motor installed at the frame unit and generating a linear reciprocating driving force;

a compression unit installed at the frame unit with a certain distance from the reciprocating motor, receiving the driving force of the reciprocating motor and compressing gas;

a spring unit for elastically supporting the linear reciprocating driving force of the reciprocating motor; and a valve unit installed at the compression unit and opening/closing a compression space in which the gas is compressed, wherein a piston of the compression unit has a flange portion connected to a mover of the reciprocating motor, a distance (k) between a front frame of the frame unit and the flange portion of the piston is smaller then the distance (m) between the reciprocating motor and the flange portion of the piston, and wherein a distance (m) between the flange portion of the piston and one side of the reciprocating motor facing the flange portion is shorter than a distance (p) between the end surface of a mover of the reciprocating motor and a rear frame of the frame unit at which the reciprocating motor is installed.

8. A reciprocating compressor comprising;

a container having a suction pipe in which gas is sucked, a frame unit frame installed inside the container;

a reciprocating motor installed at the frame unit and generating a linear reciprocating driving force;

a compression unit installed at the frame unit with a certain distance from the reciprocating motor, receiving the driving force of the reciprocating motor and compressing gas;

a spring unit for elastically supporting the linear reciprocating driving force of the reciprocating motor; and a valve unit installed at the compression unit and opening/closing a compression space in which the gas is compressed, wherein a piston of the compression unit has a flange portion connected to a mover of the reciprocating motor, a distance (k) between a front frame of the frame unit and the flange portion of the piston is smaller then the distance (m) between the reciprocating motor and the flange portion of the piston, and wherein an open groove at which a wound coil is placed is formed between the pole portions of the stator of the reciprocating motor, and a permanent magnet of the mover of the reciprocating motor is lopsided toward the compression unit on the basis of the center of the open groove.

* * * * *